US005330308A

United States Patent [19]

Armando et al.

[11] Patent Number: 5,330,308

[45] Date of Patent: Jul. 19, 1994

[54] AUTOMATIC REFUSE CONTAINER LOADING DEVICE

[76] Inventors: Valerio Armando, S. Lorenzo, 100; Lodovico Armando, S. Lorenzo, 86, both of I-12023 Caraglo CN; Massimo Armando, Via del Corva, 23, I-12100 Cuneo, all of Italy

[21] Appl. No.: 858,863

[22] Filed: Mar. 27, 1992

[30] Foreign Application Priority Data

Mar. 29, 1991 [IT] Italy ..... T91A000223

[51] Int. Cl.[5] ..... B65F 3/02

[52] U.S. Cl. ..... 414/408; 414/741; 414/421; 414/718; 414/546; 414/735; 414/744.6; 294/119.1; 294/902

[58] Field of Search ..... 220/1.5; 294/119.1, 294/902; 414/403, 404, 406, 407, 718, 408, 409, 621, 419, 420, 421, 422, 546, 729, 732, 738, 739, 740, 741, 742, 735, 744.6

[56] References Cited

U.S. PATENT DOCUMENTS

| | | | |
|---|---|---|---|
| 2,908,411 | 10/1959 | Ambarcumian | 414/408 |
| 3,027,028 | 3/1962 | Brown | 414/408 X |
| 3,140,788 | 7/1964 | Clar | 414/408 |
| 3,170,580 | 2/1965 | Soyko | 414/408 |
| 3,447,705 | 6/1969 | Stone | 414/408 |
| 3,765,554 | 10/1973 | Morrison | 414/408 |
| 3,858,735 | 1/1975 | Zrostlik | 414/741 X |
| 4,175,903 | 11/1979 | Carson | 414/408 |
| 4,295,778 | 10/1981 | Hergaux | 414/408 X |
| 5,071,307 | 12/1991 | Carson | 414/408 |

FOREIGN PATENT DOCUMENTS

| | | | |
|---|---|---|---|
| 3518374 | 11/1986 | Fed. Rep. of Germany | 414/421 |
| 1101386 | 7/1984 | U.S.S.R. | 414/408 |
| 1248902 | 8/1986 | U.S.S.R. | 414/408 |
| 1386536 | 4/1988 | U.S.S.R. | 414/422 |

*Primary Examiner*—Frank E. Werner

*Attorney, Agent, or Firm*—Oblon, Spivak, McClelland, Maier & Neustadt

[57] ABSTRACT

An automatic container loading device connected to an appropriate truck comprises a first telescopic arm connected to the chassis of the truck and able to rotate, both on a horizontal and on a vertical plane, a second telescopic arm centrally connected to the free end of the first arm and able to make a complete rotation on its vertical axis and comprising a third arm and a fourth arm, also able to make a complete rotation. The third and fourth arms support a mechanism for gripping containers of all shapes and sizes form any position whatsoever, even at a considerable distance from the truck and on a different level, placing them automatically in the right position for being lifted and emptied into the body of the truck.

11 Claims, 3 Drawing Sheets

AUTOMATIC REFUSE CONTAINER LOADING DEVICE

BACKGROUND OF THE INVENTION

1. Field of the Invention

This invention refers to automatic devices for loading refuse bins.

The invention refers in particular to devices connected to the motor-vehicles used for the collection of urban waste which are able to grip, lift and empty the containers into the body of the motor-vehicles.

2. Discussion of the Related Art

Traditionally, containers are gripped by arms anchored to the rear of the truck after the container has been manually positioned in correspondence with the lifting device. Other container loading systems foresee the possibility of gripping the container by means of an arm situated on the side of the truck, in such a way as to reach the containers, even if not situated near the container itself; however, this case also requires that the container be manually positioned to permit it to be perfectly gripped by the arm.

The fact should be emphasized however that the systems briefly described above require preliminary, manual positioning of the containers, not only to ensure gripping but also to permit them to be positioned in such a way as to allow emptying into the body of the truck.

SUMMARY OF THE INVENTION

The object of this invention is to create a device which permits the gripping, positioning, lifting and emptying of the container inside the truck, operating exclusively from the cabin, without the need for the manual handling of the container, the whole operation being carried out by one person, with considerable savings on costs. This end can be achieved with the use of an automatic container loading device with the following characteristics:

- a first multi-extraction telescopic arm connected to the chassis of the truck and able to rotate on a horizontal and on a vertical plane;
- a second arm, also telescopic, connected centrally to the free end of the first arm and able to rotate 360 degrees on its own vertical axis;
- a third and fourth arm connected to the free ends of the second arm, able to rotate 360 degrees on their horizontal axes;
- means for gripping the sides of the containers, connected to the free ends of the third and fourth arms;
- hydraulically controlled equipment for the extraction of the first and second arms;
- hydraulically controlled equipment for the rotation movement of the first arm;
- means for the rotation movement of the second, third and fourth arms.

The automatic container loading device thus constructed permits gripping containers of all shapes and sizes from any position whatsoever, even at a considerable distance from the truck and on different levels, placing them automatically in the right position for being lifted and emptied into the body of the truck.

BRIEF DESCRIPTION OF THE DRAWINGS

A description is given below of a practical example of the invention in object, which is however purely indicative and not binding, with reference to the enclosed drawings in which.

DESCRIPTION OF THE PREFERRED EMBODIMENT

Figure 1:
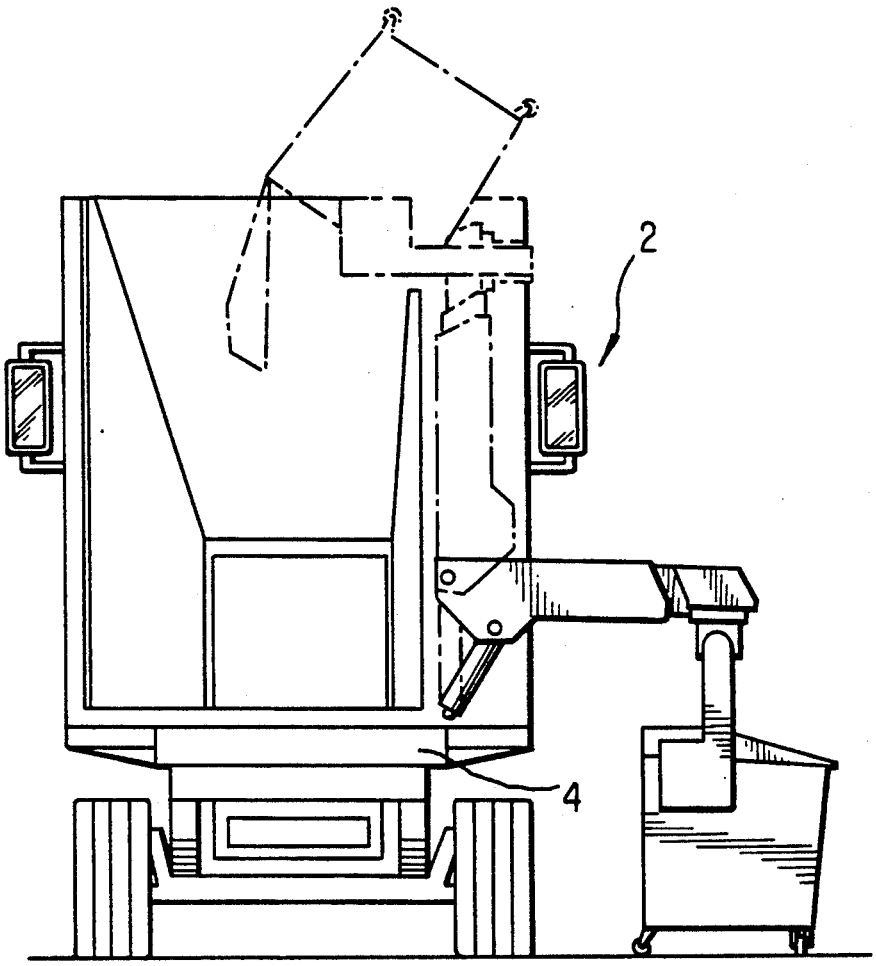
FIG. 1 is the sketch of the device, with lateral application to the truck, illustrated in two different operating positions.

With reference to the enclosed figures, 2 indicates the complete device, applied to a truck 4 fitted out for the collection of refuse (see FIG. 1).

Figure 2:
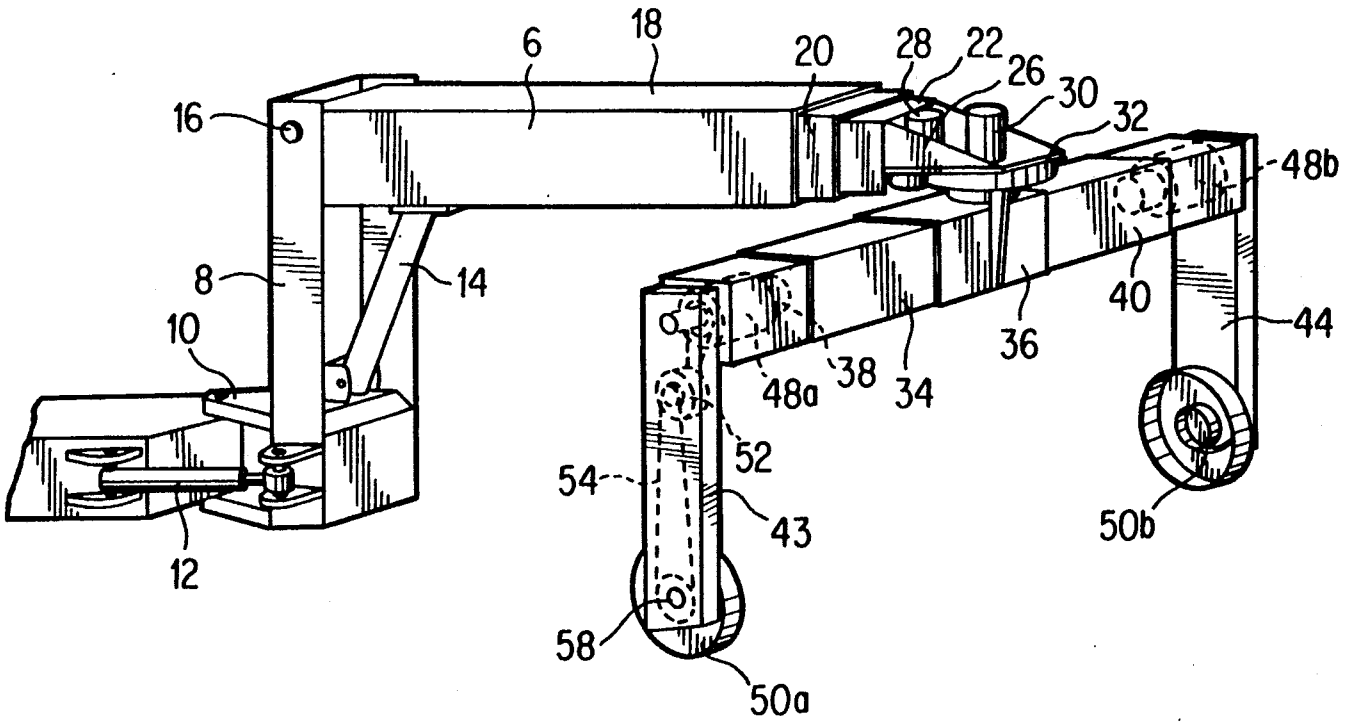
FIGS. 2 and 3 are perspective views of the device, each illustrating certain details.
Figure 3:
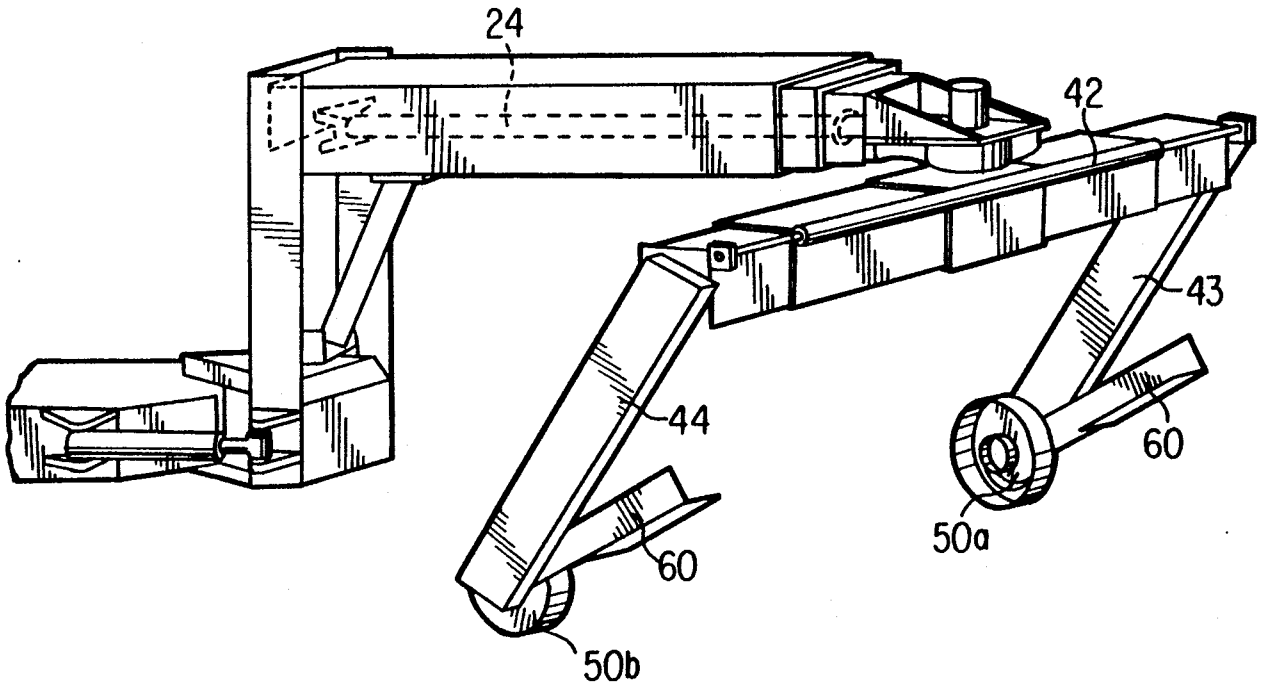

As shown in FIGS. 2 and 3, the device consists of a first arm 6 balanced on the upper end of a strong tubular support 8 which in turn has a revolving connection, by means of a bracket 10 and a support, welded to the chassis of the truck.

The tubular support 8 is also connected to the supporting structure by means of a hydraulic cylinder 12 which gives a 30 degrees rotation movement to the tubular support 8 and, consequently, also to the arm 6.

A second hydraulic cylinder 14 connects the lower part of the arm 6 to the internal part of the tubular support 8, permitting the arm 6 to be lifted and to make a rotary movement of 90 degrees around its fulcrum 16.

The arm 6 is of the telescopic type with extractable elements 18, 20 and 22 with movement guaranteed by a cylinder 24 illustrated in FIG. 3, positioned inside the arm itself.

The free end of the internal element of the arm 6 is provided with a support 26 which houses a hydraulic motor 28 and 5-way rotating joint 30, while a wheel 32, moved by the motor 28 is fixed to the lower part of the support 26 and, by means of the joint 30 connects the first arm 6 to a second telescopic arm 34.

The second arm 34 is composed of a central part 36 and of at least two side elements 38, 40 with extraction controlled by a cylinder 42.

The second arm 34 can also consist of a cylinder centrally balanced on the end of the first arm 6, of the bilateral, double extraction type. This cylinder is able to rotate 360 degrees on its own axis, just as the extractable elements are able to make an identical rotation.

A third and fourth arm, indicated respectively by reference numerals 43 and 44, are connected to the ends of the two side elements 38 and 40 of the second arm; connection is made through a pin protruding from motor-reducers 48*a* and 48*b* housed inside the lateral elements. These motor-reducers 48*a*, 48*b* permit complete rotation of the third and fourth arms 43 and 44.

Each of the free ends of the arms 43 and 44 are connected to spiral-like elements 50*a* and 50*b*, each of which is given a rotation movement by means of a hydraulic motor 52 through a belt or chain 54 and a gear wheel or pulley 56 mounted on a pin 58.

Two levers 60, also connected to the pins 58, serve to open the container lid with a complete rotation movement given by a motor (not illustrated).

The spiral-like elements 50*a* and 50*b* can be replaced by two anchor gripping systems with gravity operation.

Having brought the truck near to the container to be emptied, whatever the position of the latter, working on appropriate controls in the driving cabin, the operator will calculate the extraction of the elements 18, 20 and 22 of the first arm 6 until the second arm 34 is situated exactly above the container; extraction of the first arm 6 is automatically stopped by means of appropriate sensors or photoelectric cells. The second arm 34, placed in an open position, due to the action of the cylinder 42 which controls extraction of the two mobile elements of which it consists, and lowered, by the vertical rotation of the first arm 6, until it is in proximity with the container, is locked, always by means of the cylinder 42, foreseen with double action, in such a way that the spiral-like elements 50*a* and 50*b* mounted on the side arms 43 and 44 connected to the second arm 34, grip pins which protrude from the sides of the container.

Working the hydraulic motor 52 for rotating the spiral-like elements 50*a* and 50*b*, the latter will rotate until the container is perfectly blocked, at the same time keeping it perfectly aligned with the second arm 34.

At this point it will be possible to rotate the second arm 34 by means of the rotating joint 30 and the wheel 32 in such a way as to place the container in the position required, in other words, with the lid opening as shown in FIG. 1.

At this point, having brought the extractable elements 18, 20 and 22 of the first arm 6 into position, the latter will make a 90 degree upwards rotation and the side arms 43 and 44 of the second arm 34 will rotate in order to discharge the contents of the container into the hopper of the truck body.

We claim:

1. An automatic device connected to a truck for unloading refuse from a refuse collection container into the truck, the device comprising:

a first multi-extractable telescopic arm connected to a chassis of the truck, said first arm being rotatable about a horizontal and a vertical plane;

a second telescopic arm centrally connected to a free end of said first arm and rotatable by 360 degrees about a vertical axis of said second arm;

third and fourth arms connected to free ends of said second arm and rotatable by 360 degrees about respective horizontal axes of each of said third and fourth arms;

gripping means for gripping side portions of said collection container, said gripping means being connected to respective free ends of each of said third and fourth arms;

control means for rotating said first arm about said horizontal and vertical planes;

means for rotating said second arm about said vertical axis of said second arm; and means for rotating said third and fourth arms about said respective horizontal axes of said third and fourth arms;

wherein rotation of said first, second, third and fourth arms transports a refuse collection container to/from a first position adjacent to said truck to/from a second position in which refuse in said container is unloaded into said truck.

2. A device according to claim 1, further comprising a tubular support which connects said first arm to the chassis of the truck, said first arm being balanced on an upper end of said tubular support, a further end of said tubular support having a movable connecting bracket which is welded to a support on the chassis of the truck.

3. A device according to claim 2, wherein said control means comprises a first cylinder and the tubular support is connected to the support of the truck by means of said first cylinder which provides a 30 degree rotation to said tubular support and to said first arm.

4. A device according to claim 3, wherein said control means further comprises a second cylinder which connects a lower part of said first arm to an internal part of said tubular support for permitting a 90 degree vertical rotation of said first arm.

5. A device according to claim 1, wherein said first arm comprises a plurality of extractable elements and a third cylinder positioned inside said first arm for extracting said elements.

6. A device according to claim 1, wherein said means for rotating said second arm comprises a rotating joint and a first wheel which connect the first arm to the second arm and permit said 360 degree rotation of said second arm about said vertical axis of said second arm.

7. A device according to claim 6, further comprising a hydraulic motor mounted on a free end of an internal element of said first arm and providing a rotating movement to said first wheel.

8. A device according to claim 1, wherein the second arm comprises a plurality of extractable mobile elements and a fourth cylinder for extracting said mobile elements.

9. A device according to claim 8, comprising two motor-reducers housed inside said mobile elements of the second arm for permitting rotation of the third and fourth arms.

10. A device according to claim 1, wherein said gripping means are spiral-shaped.

11. A device according to claim 10, wherein said spiral-shaped gripping means are rotated by hydraulic motors positioned inside each of said third and fourth arms.

* * * * *